US006565276B1

(12) United States Patent
Diaz

(10) Patent No.: US 6,565,276 B1
(45) Date of Patent: May 20, 2003

(54) ELECTRICALLY DRIVEN HAND-HELD DEVICE FOR EYELASH MASCARA APPLICATION

(76) Inventor: Lina Faye Howard Diaz, 265 N. 7th St., Colton, CA (US) 92324

( * ) Notice: Subject to any disclaimer, the term of this patent is extended or adjusted under 35 U.S.C. 154(b) by 0 days.

(21) Appl. No.: 10/143,663

(22) Filed: May 10, 2002

(51) Int. Cl.[7] ..... A45D 40/26

(52) U.S. Cl. ..... 401/129; 401/119; 401/118; 132/218; 132/216; 132/119.1; 15/25; 15/26; 15/34

(58) Field of Search ..... 132/218; 15/22, 15/23, 24, 25, 26, 27, 28, 29, 30, 31, 32, 33, 34; 401/119, 129

(56) References Cited

U.S. PATENT DOCUMENTS 576,187 A * 2/1897 Eaton ..... 401/121
3,084,374 A * 4/1963 Ziegler ..... 401/122
3,980,906 A * 9/1976 Kuris et al. ..... 310/317
4,156,620 A * 5/1979 Clemens ..... 134/6
4,175,574 A * 11/1979 Zulberti ..... 401/122
4,326,314 A * 4/1982 Moret et al. ..... 15/22.1
4,397,326 A * 8/1983 Formica ..... 132/218
4,632,136 A * 12/1986 Kingsford ..... 132/218
5,341,534 A * 8/1994 Serbinski et al. ..... 15/22.1
5,875,791 A * 3/1999 Sheffler et al. ..... 132/218
6,178,579 B1 * 1/2001 Blaustein et al. ..... 15/28
6,241,411 B1 6/2001 Brieva et al.
6,314,967 B1 11/2001 Castells Ribas

* cited by examiner

*Primary Examiner*—David J. Walczak
*Assistant Examiner*—Azadeh Kokabi

(57) ABSTRACT

This invention provides a mascara and a like cosmetics application onto the eyelashes. An improved electrically driven hand-held device for eyelash mascara application includes a mascara container coupled with the brush handle, including a power supply electrically connected through the electrical switch to the reversible motor, the shaft of which is coupled by a connecting means with the rod of the brush, and wherein the reversible motor provides the rotation of the brush with the mascara onto it during engagement with the eyelashes.

3 Claims, 2 Drawing Sheets

ELECTRICALLY DRIVEN HAND-HELD DEVICE FOR EYELASH MASCARA APPLICATION

FIELD OF THE INVENTION

The invention relates to makeup devices and more particularly to devices including a container with mascara and brush intended for application of mascara and a like cosmetics to the eyelashes.

BACKGROUND OF THE INVENTION

The principles to apply a mascara to the eyelashes are described in the known prior art, but in order to obtain the optimal results, ideally each lash has to be liberally and uniformly coated with the mascara, and the lashes has not to be clumped together. Usually, the more thickly mascara is applied, the greater the tendency is for the lashes to clump together. Mostly, in the devices described in the prior art the attention is brought to the brush and/or dispenser design. For example, the brushes which are designed to provide thick application of mascara often have bristles spaced so closely together that the lashes cannot penetrate the bristle. This contributes to clumping On the other hand, brushes with fewer bristles permit eyelashes to pass through the bristle. However, due to the reduced bristle density on such brushes, they are often not capable of thickly coating mascara onto the eyelashes because there are fewer bristles onto which mascara is loaded. In order to overcome the described above aspects and some other difficulties related to the eyelashes coating, the procedure of the eyelashes coating has to be repeated a few times for the same The U.S. Pat. No. 6,314,967 provides the brush improvement. A brush conventionally based on a metal wire folded on itself and twisted in a spiral to form an attachment core for fiber tufts forming the brush itself, that includes two types of fibers, namely plastic fibers, for example, made of nylon, and vegetable fibers, for example, made of cotton, linen or the like. The tufts of both types fibers are laid out alternately such that the vegetable fibers "stock" the makeup product, thus facilitating impregnation of the plastic fibers when these plastic fibers come into contact with the user's eyelashes, making it possible to apply the mascara in a single pass.

This device has a complex brush, which contains the "vegetable" material not intended and reliable for a long lime of the frequentative use, that is inconvenient. Additionally, the impregnation of the plastic fibers will not be uniform, that can require more than single pass of the mascara's application.

While these devices fulfill their respective, particular objectives and requirements, the mentioned patents do not disclose the eyelashes mascara application device including an reversibly rotatable eyelashes brush for the eyelashes coating.

Thus, the known prior art do not provide an efficient, satisfied and convenient application of the makeup (mascara) to eyelashes in a single pass, and in theses respects, an improved electrically driven hand-held device for eyelash mascara application with the rotatable eyelashes mascara applying brush according to the present invention substantially departs from the devices of the prior art.

OBJECT AND ADVANTAGES OF THE INVENTION

Accordingly, several objects and advantages of the present invention are to provide an improved eyelash mascara device.

It is another object of the invention to provide a mascara application to the eyelash in a single pass.

It is still another object of the invention to provide the brush reversible rotation for left- and/or right-handed users.

It is further object of the invention to increase convenience of the improved electrically driven hand-held device for eyelash mascara application eliminating the manual rotation of the brush during eyelashes coating.

DESCRIPTION OF THE DRAWING

In order that the invention and the manner in which it is to be performed may be more clearly understood, embodiments thereof will be described by way of example with reference to the attached drawings, of which.

SUMMARY OF THE INVENTION

In view of the foregoing disadvantages inherent in the known prior art, the present invention provides a new electrically driven hand-held device for eyelash mascara application eliminating the manual rotation of the brush during eyelashes coating. As such, the general purpose of the present invention, which will be described hereinafter in greater details, is to provide a new electrically driven hand-held device for eyelash mascara application, which has many of the advantages of the eyelashes coating instruments mentioned heretofore and many novel features that result in the rotating eyelashes brush, which is not anticipated, rendered obvious, suggested or even implied by any of prior art eyelashes mascara application devices, either alone or in any combination thereof To attain this, the present invention generally comprises the device for the mascara and a like cosmetics application to the eyelashes. An improved electrically driven hand-held device for eyelash mascara application includes a mascara container coupled with the brush handle, including a power supply electrically connected through the electrical switch to the reversible motor, the shaft of which is coupled by a connecting means with the rod of the brush, and wherein the reversible motor provides the rotation of the brush with the mascara onto it during engagement with the eyelashes.

DESCRIPTION OF THE PREFERRED EMBODIMENTS

Figure 1:
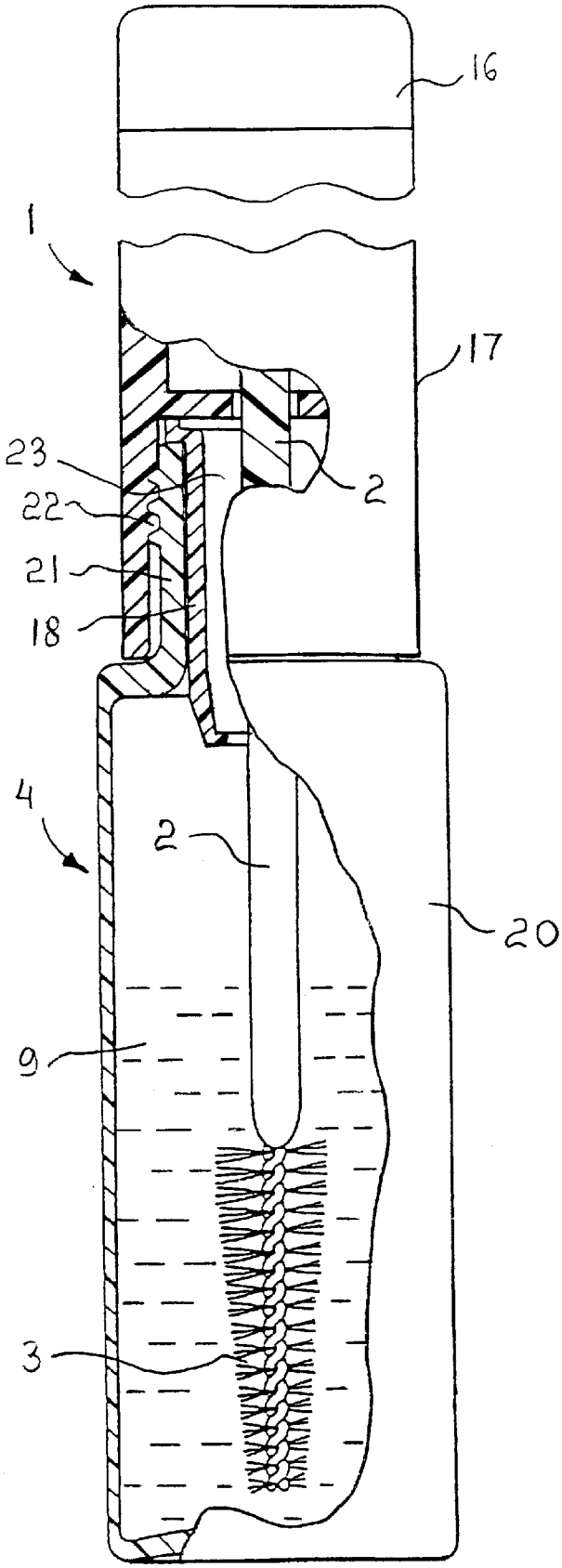
FIG. 1 is a simplified representation of the improved electrically driven hand-held device for eyelash mascara application.
Figure 2:
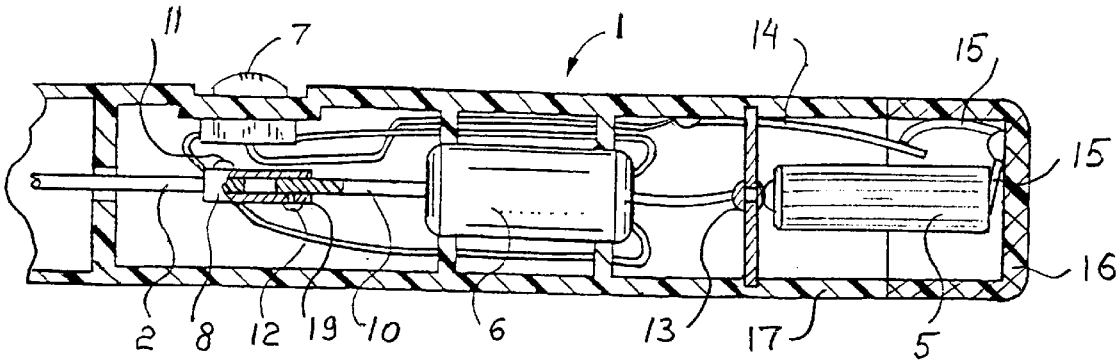
FIG. 2 is a simplified drawings of the brush handle portion.
Figure 3:
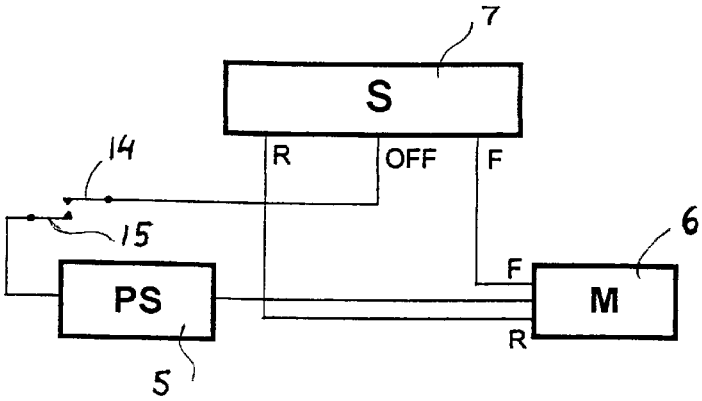
FIG. 3 is a simplified structural electrical scheme.

With reference now to the drawings and particularly to FIGS. 1–3 thereof, a new electrically driven hand-held device for eyelash mascara application embodying the principles and concepts of the present invention.

Referring to FIG. 1, an improved electrically driven hand-held device for eyelash mascara application comprises a brush handle 1, including a power supply 5 (any kind of batteries can be used, e.g. "AA-AAA"-style batteries, watch batteries, etc.), a reversible motor 6 (preferably the low speed reversible motor), a electrical switch 7 and a connecting means 8. Also the improved eyelashes device includes a brush rod 2 coupled with the brush (applicator) 3, and a mascara 9 within container 4. The brush handle 1 has an elongated configuration. The reversible motor 6 comprises the shaft 10 extended into the connecting means 8. The brush rod 2 is coupled with the another side of the connecting means 8. The connection means 8, for example, can have gear system or as shown in FIG. 2 the cylindrical body 19 of cylindrical configuration with two screws 11 and 12 located onto two opposite sides of the cylindrical body of the connecting means 8 preferably at 180° angle respectively. Such housing of the screws 11 and 12 provides the better balance during rotation. The screws 11 and 12 fixedly connect the shaft 10 of the motor 6 and the brush rod 2 to the cylindrical body 19 (the appropriate apertures into the cylindrical body 19 for the screws 11 and 12 are not shown). The reversible motor 6 is electrically connected to the electrical switch 7, which is electrically connected to the power supply 5. The electrical switch 7 can have, for example. the three positions: "F"—"OFF"—"R" in order to provide clockwise (forward—"F") and counter-clockwise (reverse -"R") rotations of the brush 3, as shown in FIG. 3. The reverse provides the equal possibility for the right -hand and left-hand users and for the users, who coating the right eyelashes with the right hand and the left eyelashes with the left hand. Also, the reverse provides the best eyelashes coating for the single pass. The switch's position "OFF" is between positions "F" and "R" in order to provide the switching from "F" to "R" and from "R" to "F" through position "OFF".

The brush handle 1 can have a solid structure (not shown) with the fixedly installed battery(s) 5. Also, as shown on FIGS. 1 and 2, the brush handle 1 can include a handle body 17 comprising the installed motor 5, connecting means 8 and switch 7, and the handle top (cup) 16 intended for battery 5 installation through the opening in the handle body 17.

The handle top 16 of the handle 1 is non-fixedly coupled with the handle body 17 and provides the replacement of the power supply (e.g. battery or batteries) 5 into handle body 17. For electrical connection of the battery 5 to the electrical switch 7 and to the motor 6 are used the group of electrical contacts 13, 14 and 15 as, for example, shown in FIG. 2. The first electrical contacts 13 and second electrical 14 are fixedly coupled with the handle body 17 and electrically connected to the reversible motor 6 and to the switch 7 respectively, and the third electrical contact 15 is fixedly coupled with the handle top 16. When the handle top 16 is inserted in/on the handle body 17 of the brush handle 1, the contacts 14 and 15 are connected (see, for example, FIG. 3). For instance, as shown in FIG. 2, the electrical contact 13 is permanently connected to the motor 6 and the electrical contact 14 is permanently connected to the electrical switch 7.

The power supply 5 can be presented by a spring-actuated mechanism for brush 3 rotation. In this case, the improved eyelashes mascara application device includes an outer actuating handle (not shown) mounted on the of the brush handle and coupled with the inner spring (for instance, a spiral spring—not shown), the rod (the axis) of which is connected to the brush rod 2 (for example, through the connecting means or preferably through the speed-stabilizing means. e.g. such as an inertial wheel etc.—not shown).

The brush rod 2 of the handle 1 and the mascara dispenser 18 preferably have to be made of the material with the minimal coefficient of the friction.

The mascara container 4 includes an elongated vial 20 with an opening 23 for brush 3 passage and an externally threaded neck 21, in which the mascara dispenser 18 is installed, as shown in FIG. 1. The internal thread 22 of the brush handle 1 is engaged with the threaded neck 21. The mascara dispenser 18 is fixedly connected to the vial's neck.

CONCLUSION, RAMIFICATION AND SCOPE

Accordingly the reader will see that, according to the invention, I have provided a convenient electrically driven hand-held device for eyelash mascara application. There has thus been outlined, rather broadly, the more important features of the invention. In this respect, it is understood that the invention is not limited in its application to the details of construction and to the arrangements of the components set forth in the description and/or drawings. The invention is capable of other embodiments and of being practiced and carried out in various ways. Also, it is to be understood that the phraseology and terminology employed herein are for the purpose of description and should not be regarded as limiting.

While the above description contains many specificities, thee should not construe as limitations on the scope of the invention, but as exemplification of the presently-preferred embodiments thereof Many other ramifications are possible within the teaching to the invention, For example, an improved electrically driven hand-held device for eyelash mascara application can be successfully used by the users who are incapable manually rotate brush (e.g. the users with polyarthritis disease, finger coordination malfunction, etc.).

As such, those skilled in the art will appreciate that the conception, upon which this disclosure is based, may readily be utilized as a basis for the designing of other structures, for carrying out the several purpose of the present invention, It is important, therefore, that the claims be regarded as including such equivalent constructions insofar as they do not depart from the spirit and scope of the present invention.

What is claimed is:

1. An electrically driven hand-held device for eyelash mascara application, including:

a mascara container comprising
- a vial including an opening for a brush passage into said vial;
- a mascara dispenser fixedly connected with an externally threaded neck of said vial;

a brush handle comprising
- a power supply electrically connected to a switch;
- a reversible motor electrically connected to said power supply, and through electrical contacts to said switch;
- a connecting means coupling a rotor of said reversible motor with a rod of a brush, and wherein said brush handle is coupled by a thread with said threaded neck of said vial.

2. A device of claim 1, wherein said brush handle further includes a handle body and a handle cup providing a replacement of said power supply through an opening, in said handle body.

3. A device of claim 2, wherein said brush handle includes connectable electrical contacts, one of which is fixedly connected to the switch and another contact is fixedly connected to said handle cup, and wherein an electrical contact between said connectable electrical contacts is provided at the time of the coupling of said handle cup with said handle body.

* * * * *